United States Patent [19]

Livick

[11] 4,026,173

[45] May 31, 1977

[54] ADJUSTABLE DEVICE FOR FEEDING WORK PIECES OF DIFFERENT THICKNESSES PAST A RIP SAW FOR CUTTING PURPOSES

[76] Inventor: Lester R. Livick, 15106 Beatty St., San Leandro, Calif. 94579

[22] Filed: Aug. 11, 1976

[21] Appl. No.: 713,392

[52] U.S. Cl. ..... 83/421; 83/425; 83/438; 83/477.2

[51] Int. Cl.[2] ..... B27B 25/10

[58] Field of Search ..... 83/421, 425, 477.2, 83/438

[56] References Cited

UNITED STATES PATENTS

| | | | |
|---|---|---|---|
| 2,739,625 | 3/1956 | Peters | 83/425 |
| 2,799,303 | 7/1957 | Lee | 83/425 |

*Primary Examiner*—Frank T. Yost
*Attorney, Agent, or Firm*—William R. Piper

[57] ABSTRACT

An adjustable device for feeding work pieces of different thicknesses past a rip saw for cutting purposes in which a guide rail is attached to the adjustable fence on the rip saw table. A work engaging and moving member is slidable along the guide rail for moving the work into cutting engagement with the rip saw. The work engaging and moving member can be adjusted to move work pieces of various thicknesses past the rip saw for cutting. The fence and guide rail may be adjusted with respect to the rip saw to cut pieces of a desired width. A work-holding and feeding member is adjustably carried by the device and cooperates with the work engaging and moving member.

3 Claims, 4 Drawing Figures

ADJUSTABLE DEVICE FOR FEEDING WORK PIECES OF DIFFERENT THICKNESSES PAST A RIP SAW FOR CUTTING PURPOSES

SUMMARY OF THE INVENTION

It is hazardous for an operator to feed a work piece only about one-fourth inch thick by hand into cutting engagement with a high speed rip saw where the width of the cut piece is also to be narrow because this positions the fence, which determines the width of the cut piece, very close to the rip saw and the vibration of the work piece enduced by the saw might cause the work piece to slip and permit the operator's hands to contact the saw with disastrous results.

An object of my invention is to provide a device in which an adjustable work engaging and moving member is movable along a guide rail for feeding work pieces of different thicknesses into cutting engagement with a high speed rip saw. The guide rail is secured to the standard adjustable fence on the rip saw table so that the width of the cut piece can be determined. The work engaging and moving member can be adjusted to accommodate work pieces of various thicknesses. The operaor moves the work engaging member along the guide rail by grasping a handle which extends to the other side of the fence from that of the rip saw. In this way the operator's hands at no time are positioned near the rip saw.

DESCRIPTION OF THE PREFERRED EMBODIMENT

Figure 1:
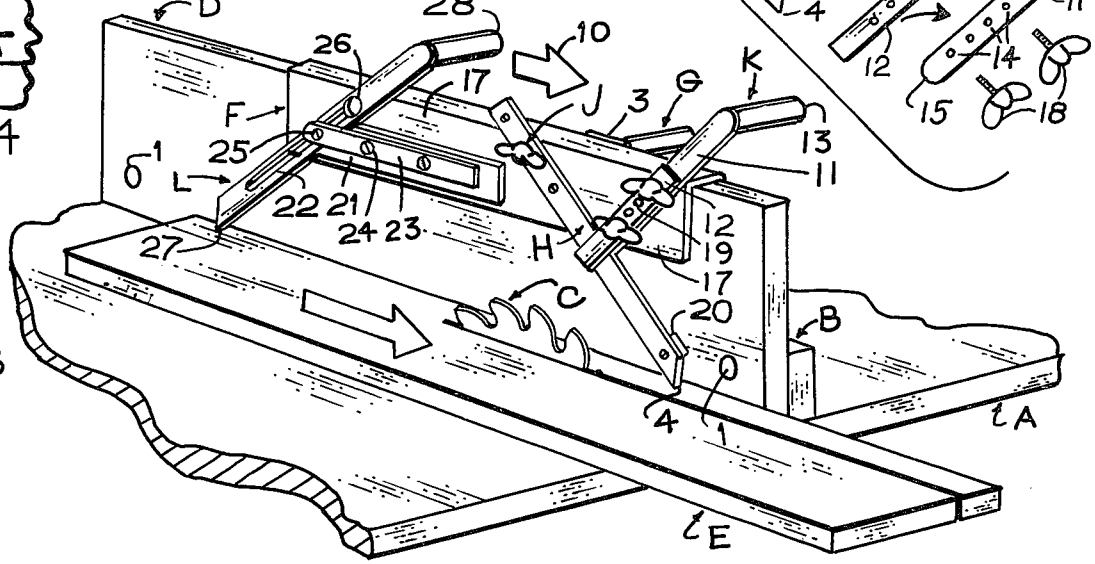
FIG. 1 is a perspective view showing my device mounted on a standard rip saw table with both the adjustable work engaging and moving member and the work-holding and feeding member contacting a work piece.

In carrying out my invention, I make use of a standard rip saw table indicated generally at A, in FIG. 1, and the table carries a fence B, which is adjustable toward and away from a circular rip saw C so as to determine the width of the work piece to be cut. It has been the customary practice for an operator to place on the table A, the work piece to be cut, and then move the work piece toward the rip saw by hand while guiding it so that the left hand edge of the work piece contacts and slides along the adjacent face of the fence B. This is quite a hazardous operation, especially if the work piece to be cut is only about one-fourth of an inch thick and the operator desires to cut a very narrow piece.

Figure 3:
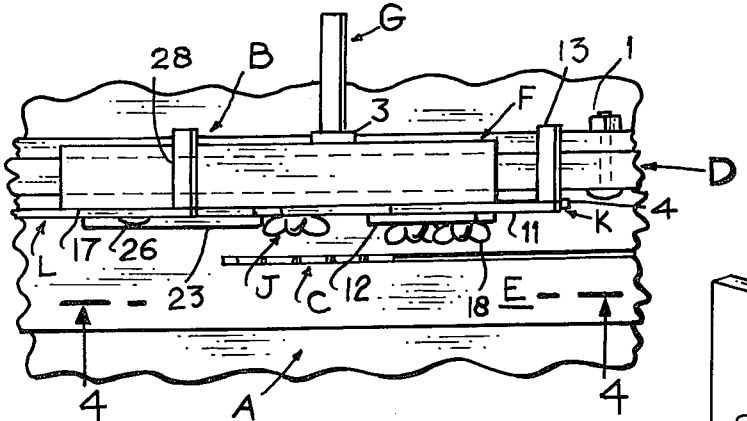
FIG. 3 is a top plan view of FIG. 1.
Figure 4:
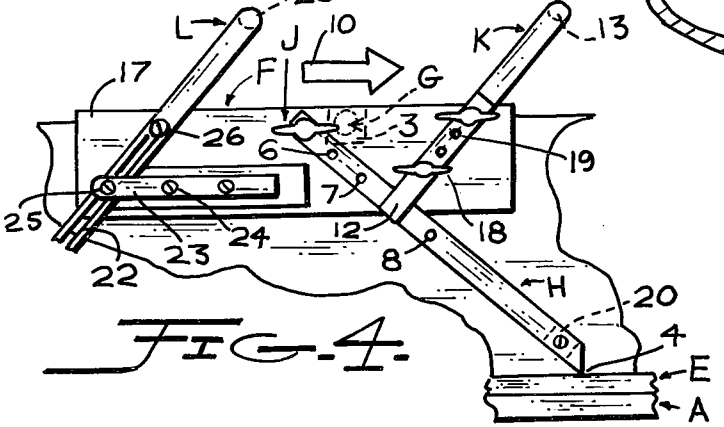
FIG. 4 is a side elevation of my invention showing the work piece engaging and moving member in a different position.

My invention removes the above-mentioned hazard since I provide a device which will grip the work piece to be cut and move it into cutting engagement with the rip saw without the operaor needing to place his hand on the piece to force it against the saw. Also my device can be adjusted to accommodate work pieces of different thicknesses from about one-fourth of an inch to about two and one-half inches. FIGS. 1, 3 and 4, illustrate a guide rail D attached to the fence B, by any suitable fastening means such as by carriage bolts 1, clearly shown in FIG. 3. The standard fence B is already provided with openings therein and the heads of the carriage bolts 1 are countersunk in the guide rail D so as not to interfere with any work piece E that contacts with the guide rail and is to be moved along the table top in order to be cut by the rip saw C.

I provide a carriage F, that is U-shaped in cross section and designed to straddle the top edge of the guide rail D, and to be moved along the rail, see FIGS. 1 to 4, inclusive. A handle G, see FIG. 2, had a threaded shank 2 which is received in a threaded bore provided in a boss 3 that is integral with the side of the carriage F, see also FIG. 3. The handle G projects laterally from the side of the carriage F so as to extend away from the rip saw C. In this way the guide rail D, acts as a protection for the operator's hand that grips the handle G because it lies between the hand and the saw.

Figure 2:
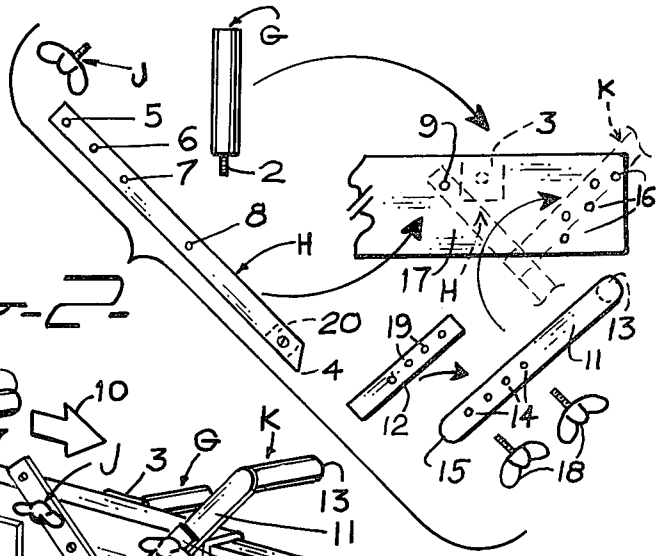
FIG. 2 is an exploded view of some of the parts used in my invention.

The carriage F adjustably carries an elongated work engaging and moving member H, and it is mounted on the opposite side of the carriage from that of the handle G, see FIGS. 1 and 2. The member H, is preferably made from flat metal and it has a work-engaging point 4 at one end and a series of spaced apart openings 5, 6, 7 and 8, clearly shown in FIG. 2. The carriage F had a threaded opening 9 in the side disposed opposite to the handle G, and a butterfly-headed stud J, is insertable through any desired one of the holes 5 to 8 inclusive, and is received in the threaded opening 9 to adjustably secure the member H to the carriage F. When the winged stud J, is in the opening 5, see FIG. 2, the work-engaging member H, is fully extended and its pointed end 4 will properly engage the work piece E, which may be from one-fourth to three-eighths of an inch in thickness. The member H contacts the work piece E at the proper angle for advancing the piece toward the rip saw C, as the carriage is manually moved in the direction of the arrow 10, see FIGS. 1 and 4.

It is necessary to hold the work-engaging member H, at the proper angle with respect to the plane of the work piece E that is to be cut. I provide an adjustable stop K, and composed of two elongated pieces 11 and 12, as shown in FIG. 2, for holding the work-engaging and moving member H, at the proper angle with respect to the plane of the work piece E. The piece 11 is provided with a handle 13 at one end and with a plurality of holes 14 arranged in a linear row extending from the opposite end which is rounded to form a half circle 15. The carriage F has a plurality of threaded openings 16 in its side 17 and the adjustable stop K can be secured to the side 17 by winged studs 18 that have their threaded shanks inserted in the desired openings 14 and threaded into the proper openings 16 for causing the rounded end 15 to contact the adjacent edge of the work engaging and moving member H.

The piece 12 of the work-engaging and moving member H functions as a keeper for overlying the member H, see FIG. 1, and holding it in contact with the side 17 of the carriage F. The keeper piece 12 has a linear row of openings 19 that are spaced the same distance apart as are the openings 14 in the piece 11. After the piece 11 has had its certain openings aligned with the proper openings 16 in the side 17 of the carriage F so that the rounded end 15 of the piece 11 contacts with the work-engaging and moving member H, then the keeper piece 12 is positioned over the piece 11 so that its lower end overlaps the member F, after which certain openings 19 in the piece 12 are aligned with the proper openings 14 in the piece 11 and are also aligned with the proper openings 16 in the side 17 of the carriage F whereupon the threaded shanks of the winged studs 18 are inserted into the aligned openings 19 and 14 and screwed into the threaded openings 16 for securing the parts together. It will be seen from FIGS. 1, 2 and 4, that a spacer piece 20 is secured to the inner surface of the member H, and adjacent to the pointed end 4 for spacing the lower end of the member H from the guide rail D, as is the portion of the member H contacting the side 17 of the carriage F.

The work-engaging member H should be at a proper angle with respect to the plane of the work piece E so that the pointed end 4 will engage with the work piece to move it toward the rip saw C, as the operator moves the carriage F along the guide rail D. I have shown in FIG. 4 how the wing-headed stud J, is inserted into the top opening 5 in the work-engaging member H, and into the opening 9 in the carriage F when the pointed end thereof is to engage work pieces E having a thickness between one-fourth inch to one-half inch. The adjustable stop K, is secured in the proper threaded openings 16 in the carriage F so that its lower rounded end 15 will contact the adjacent edge of the work-engaging member H for holding it at the proper angle with respect to the plane of the work piece E. Should the work piece E have a thickness between three-fourths inch to one and one-quarter inches, the winged headed stud J, is transferred to the third hole 7 in the work-engaging member H, see FIG. 2 and the parts would assume the positons shown in FIG. 1. In like manner, the work-engaging member H, and the adjustable stop K can be adjusted to handle work pieces E having thicknesses between one and one-half inches and one and three-fourth inches or between two and one-fourth inches to two and one-half inches.

It is advisable to provide a work holding and feeding member L, in addition to the work-engaging and moving member H, so that the work piece E will be contacted at two spaced apart points, see FIG. 1. The member L, and its associate parts are sufficiently illustrated in the perspective view of FIG. 1, so that it need not be further shown in the other Figures. A guide means such as plate 21 is positioned against the face 17 of the carriage F, and it has an inclined left hand edge which abuts the adjacent edge of the member L and holds it at an angle extending in an opposite direction to the angle of the member H. An elongated slot 22 is formed in the member L, and a keeper bar 23 has its left hand end extending over the member L. A pair of screws 24 extend through the bar 23, the guide plate 21 and are threaded into openings in the side 17 of the carriage F for securing these parts together as a unit. A pair of guide screws 25 and 26 have their shanks extending through the elongated slot 22 for guiding and holding the member L, in adjusted position. The screw 25 extends through the left hand end of the keeper bar 23 while the screw 26 has its shank received in the slot 22 and the threaded end of the screw extends into a threaded bore in the carriage F.

It is a relatively simple matter to loosen both guide screws 25 and 26 sufficiently to slide the member L so that its pointed end 27 will contact the work piece E regardless of the thickness of the work piece. The two screws are then tightened to secure the member L to the carriage F. A handle 28 is attached to the upper end of the member L whereby the operator may be able to adjust the member with respect to the work piece E. The two members H, and L will have their lower pointed ends 4 and 27, respectively, contact the work piece E for feeding it toward the rip saw C, as the carriage F, is moved and both members will also slidably hold the work piece in contact with the upper surface of the saw table A.

I claim:

1. In combination:

a. a table having a slot with a portion of a disc rip saw projecting therethrough and a fence paralleling the adjacent face of said rip saw and being adjustble toward and away therefrom;

b. a guide rail securable to said fence and adjustable therewith;

c. a carriage U-shaped in cross section and slidable along the top of said guide rail and having two sides slidably contacting the adjacent sides of said guide rail;

d. a work piece engaging and moving member pivotally and adjustably carried by the side of said carriage disposed nearest to the rip saw and a handle connected to and extending away from the opposite side of said carriage so as to be disposed on the opposite side of said guide rail from the saw;

e. an adjustable stop supported on the same carriage side as said work-engaging member and contacting said member after the latter has been adjusted for the work piece thickness for holding it in the desired angle so that the pointed end of said member will contact the work piece of the desired thickness; and f. whereby a manual movement of said carriage along said guide rail toward said rip saw will cause said member to move the work piece into cutting engagement with the saw, the operator's hand being disposed on the guide rail side facing away from the saw for protecting the hand.

2. The combination as set forth in claim 1: and in which a. a second work-holding and feeding member is adjustably secured to the same carriage side as supports said first-mentioned work-engaging and moving member; and b. means for maintaining said second member at an angle inclined in an opposite direction to that of said first-mentioned member, said second member having a pointed end contacting the work piece.

3. The combination as set forth in claim 2: and in which a. said first work-engaging and moving member is in the shape of an elongated strip with a row of openings therein and a wing-headed stud insertable into a desired opening screwed into a threaded opening in said carriage side for adjusting said first member to compensate for the thickness of the work piece being moved to the saw; and b. said second work-holding and feeding member is in the shape of an elongated strip with a longitudinal slot therein and a screw having its shank receivable in the slot and screwed into a threaded opening in said carriage side for permitting adjustment of said second member to compensate for the thickness of the work piece being fed toward the saw.

* * * * *